US011553768B2

(12) United States Patent
See

(10) Patent No.: US 11,553,768 B2
(45) Date of Patent: Jan. 17, 2023

(54) WEARABLE ARTICLE FOR DISPLAY OF PRECIOUS STONES

(71) Applicant: Darryl J. See, Hendersonville, NC (US)

(72) Inventor: Darryl J. See, Hendersonville, NC (US)

( * ) Notice: Subject to any disclaimer, the term of this patent is extended or adjusted under 35 U.S.C. 154(b) by 37 days.

(21) Appl. No.: 17/175,197

(22) Filed: Feb. 12, 2021

(65) Prior Publication Data

US 2022/0256985 A1 Aug. 18, 2022

(51) Int. Cl.
*A44C 25/00* (2006.01)
*A44C 15/00* (2006.01)

(52) U.S. Cl.
CPC ..... *A44C 15/0015* (2013.01); *A44C 25/002* (2013.01)

(58) Field of Classification Search
CPC . A44C 17/0208; A44C 15/0015; A44C 25/00; A44C 25/001; A44C 25/002; A44C 25/004; A44C 17/0233
See application file for complete search history.

(56) References Cited

U.S. PATENT DOCUMENTS 425,096 A * 4/1890 Fouchs ..... A44C 17/0208 63/29.1
738,700 A * 9/1903 Roitman ..... A44C 17/0208 63/29.1
3,568,467 A * 3/1971 Ellison ..... A44C 17/0208 63/29.1
3,862,550 A * 1/1975 Sengenberger .... A44C 17/0208 63/29.1
4,531,310 A * 7/1985 Acson ..... A44C 3/001 40/1.5

(Continued)

FOREIGN PATENT DOCUMENTS

CN 2479775 Y * 3/2002 ..... A44C 25/00
CN 105982405 A * 10/2016

(Continued)

*Primary Examiner* — Emily M Morgan
(74) *Attorney, Agent, or Firm* — Joseph T. Guy; Patent Filing Specialist Inc.

(57) ABSTRACT

Provided is a wearable device for displaying translucent stones and the like. The wearable device comprises a base, a back plate, a bezel and a locking element. The base comprises a cavity, at least one base locking element a recess comprising a recess void and an illumination assembly in the cavity wherein the illumination assembly comprises an illuminator capable of emitting light. The back plate is reversibly mountable on the base. The back plate comprises at least one back plate locking element. The back plate locking element is reversibly engageable with the base plate locking element. A tab is provided on the back plate which is receivable by the recess. The tab comprises a tab void which is alignable with the recess void. An illumination window in the back plate allows light to transmit through said illumination window. The back plate also comprises at least one securing recess. The bezel is reversibly mountable on the back plate. The bezel comprises a viewing window and a securing tab wherein the securing tab is received by the securing recess. A locking element extends through the aligned tab void and recess void.

11 Claims, 4 Drawing Sheets

(56) References Cited

U.S. PATENT DOCUMENTS 4,854,133 A * 8/1989 Irwin ..... A44C 3/00 63/15
5,456,095 A * 10/1995 Tawil ..... A44C 17/0216 63/15
5,530,432 A * 6/1996 Chen ..... A44C 15/0015 356/221
5,622,062 A * 4/1997 Gong-Hwa ..... A44C 15/0015 63/15
5,653,524 A * 8/1997 Gray ..... A44C 15/0015 63/15
8,240,868 B1 * 8/2012 Sims ..... A44C 15/0015 362/108
9,078,495 B2 * 7/2015 Rife ..... A44C 15/0015
10,925,358 B1 * 2/2021 Shawhan ..... A44C 15/0005
2003/0016528 A1 * 1/2003 Granite ..... A44C 15/0015 362/253
2006/0117794 A1 * 6/2006 Solomon ..... A44C 15/0015 63/1.13
2007/0223223 A1 * 9/2007 Lee ..... A44C 15/0015 362/249.01
2008/0245104 A1 * 10/2008 Steele ..... A44C 25/002 63/1.14
2009/0002983 A1 * 1/2009 Lee ..... A44C 15/0015 362/235
2011/0194276 A1 * 8/2011 Au ..... A44C 15/0015 362/104
2013/0074543 A1 * 3/2013 Vahid ..... A44C 15/00 63/1.11
2013/0329402 A1 * 12/2013 Murray ..... A44C 15/0015 362/104
2015/0000336 A1 * 1/2015 McGarry ..... A44C 25/002 63/1.11
2015/0075217 A1 * 3/2015 Disinger ..... A44C 15/0015 63/1.11
2015/0257496 A1 * 9/2015 Swift, II ..... A44C 17/0208 63/3
2015/0313329 A1 * 11/2015 Flanery ..... F21V 33/0008 362/104
2016/0213106 A1 * 7/2016 Papais ..... A44C 17/0208
2017/0068437 A1 * 3/2017 Warren ..... G05B 19/048
2017/0245600 A1 * 8/2017 Ozburn ..... A44C 25/004
2019/0239603 A1 * 8/2019 Fogel ..... A44C 17/0233
2020/0146405 A1 * 5/2020 Hall ..... A44C 25/007
2020/0170359 A1 * 6/2020 Disinger ..... A44C 17/00
2021/0186167 A1 * 6/2021 Roi-Sanginario ..... A44C 7/002

FOREIGN PATENT DOCUMENTS

DE 202015004357 U1 * 9/2015 ..... A44C 25/004
EP 0260048 A1 * 9/1987 ..... A44C 3/00
EP 2106716 A1 * 10/2009 ..... A44C 15/0015
EP 2716178 A1 * 4/2014 ..... A44C 25/00
EP 3190631 A1 * 7/2017 ..... A44C 15/0015
KR 20080002962 U * 7/2008 ..... A44C 25/00
WO WO-2014130946 A2 * 8/2014 ..... A44C 15/0015
WO WO-2015095741 A1 * 6/2015 ..... A44C 25/004

* cited by examiner

WEARABLE ARTICLE FOR DISPLAY OF PRECIOUS STONES

FIELD OF THE INVENTION

The present invention is related to a wearable article, such as a piece of jewelry, capable of reversibly engaging with a translucent precious stone such as a gem stone. More specifically, the present invention is related to a housing comprising a light source and a translucent precious stone mounting system wherein the stone can be easily replaced yet is secure when being worn.

BACKGROUND

There has always been a desire to display natural elements of beauty as jewelry. Diamonds, sapphires, rubies and such have long adorned jewelry and clothing. Stones, particularly translucent stones, have been more difficult to display since their natural beauty is typically only evident in the presence of light and particularly light transmitting through the stone.

The availability of light emitting diodes (LED's) has generated a new interest in jewelry which can incorporate translucent stones since LED's are small, generate little heat, and can be powered by a small battery. Still the packaging required to contain the LED lights, electronics related thereto and a power source has resulted in heavy, unattractive articles. The difficulty in attaching a stone has also thwarted those attempting to provide a backlit translucent stone without risk of the stone becoming dislodged during wearing.

The present invention provides a wearable article which can have mounted thereto a translucent stone wherein the translucent stone is secure yet removable to allow for different stones to be used in different environments.

SUMMARY OF THE INVENTION

The present invention is related to a wearable article suitable for displaying a backlit translucent stone which is reversibly mounted thereto.

More specifically, the present invention is related to a wearable article comprising an enclosed base wherein the base has secured thereto a backplate with a bezel secured to the backplate wherein the backplate and bezel reversibly engage with each other securing a translucent stone there between.

These and other embodiments, as will be realized, are provided in a wearable device. The wearable device comprises a base, a back plate, a bezel and a locking element. The base comprises a cavity, at least one base locking element, a recess comprising a recess void and an illumination assembly in the cavity wherein the illumination assembly comprises an illuminator capable of emitting light. The back plate is reversibly mountable on the base. The back plate comprises at least one back plate locking element. The back plate locking element is reversibly engageable with the base plate locking element. A tab is provided on the back plate which is receivable by the recess. The tab comprises a tab void which is alignable with the recess void. An illumination window in the back plate allows light to transmit through the illumination window. The back plate also comprises at least one securing recess. The bezel is reversibly mountable on the back plate. The bezel comprises a viewing window and a securing tab wherein the securing tab is received by the securing recess. A locking element extends through the aligned tab void and recess void.

DESCRIPTION

The present invention is specific to a wearable article capable of having mounted thereto a translucent stone wherein the translucent stone is backlit from within the wearable article. More specifically, the present invention is related to a wearable article comprising a base with a backplate secured to the base and bezel secured to the backplate with a translucent stone secured between the bezel and backplate.

The stone is not limited herein, however, the advantages offered by the invention are more readily appreciated with stones that are translucent or semi-transparent. Particularly preferred are natural precious or semi-precious stones and gems either as they occur naturally or as cut to expose facets and faces. Natural materials such as diamonds, rubies, sapphires, emeralds, amazonites, ambers, amethysts, ametrines, apatites, fluorites, pyrites, fuchsites, pyropes, almandines, garnets, rhodochristes, rubellites, azurites, hawks eyes, serpentines, agates, chalcedonies, iolites, jades, citrines, kunzites, tourmalines, corals, kyanites, verdites, larimars, diaspores, modavite, quartzes, zirconiums, and combinations thereof are suitable for demonstration of the invention. Synthetic stones are also suitable for demonstration of the invention.

The invention will be described with reference to the figures which are an integral, but non-limiting, part of the specification provided for clarity of the invention. Throughout the various figures similar elements will be numbered accordingly.

Figure 1:
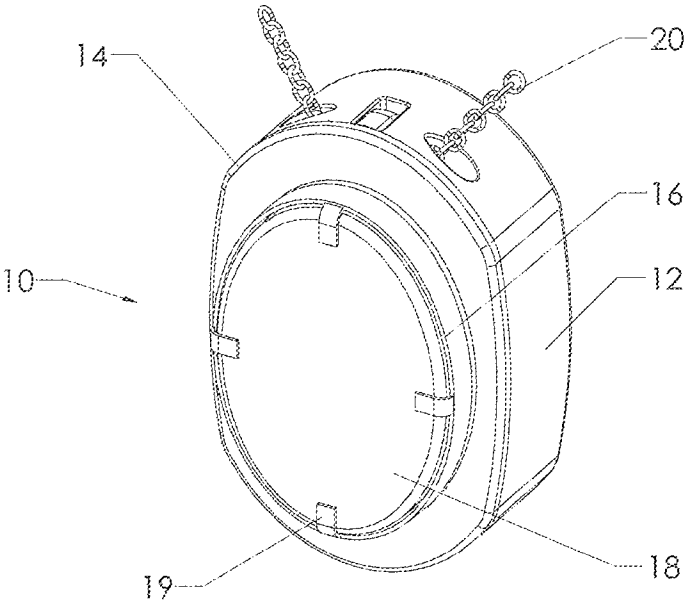
FIG. 1 is a schematic perspective view of an embodiment of the invention.

An embodiment of the invention will be described with reference to FIG. 1 wherein a wearable device of the invention is illustrated in schematic perspective view. In FIG. 1, the wearable device, 10, comprises a cavernous base, 12, with a backplate, 14, secured to the open end of the base. A bezel, 16, is reversibly attached to the backplate wherein the bezel and backplate secure a translucent stone, 18, between the bezel and backplate. A locking element, 20, secures the backplate to the base as will be realized from further description herein. Stone anchors, 19, which are preferably integral to the bezel, 16, engage with the stone to ensure the stone is incapable of traversing through the viewing window of the bezel.

Figure 2:
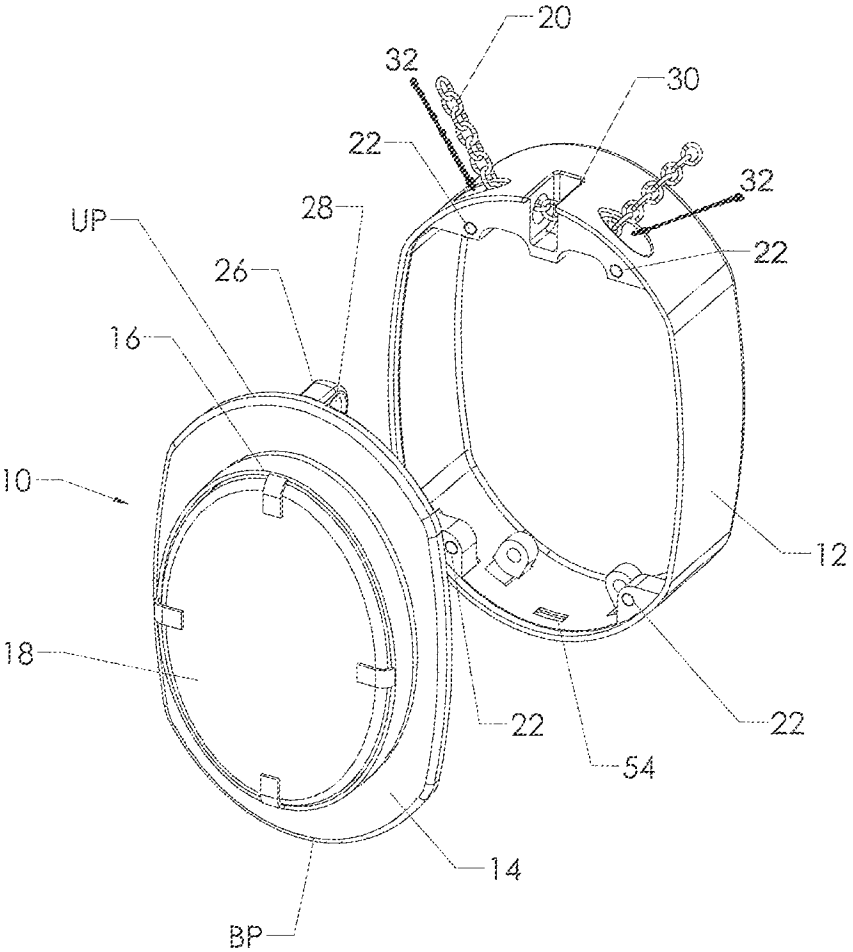
FIG. 2 is a schematic partially exploded perspective view of an embodiment of the invention.

An embodiment of the invention will be described with reference to FIG. 2 wherein the wearable device is illustrated in partial exploded schematic view. In FIG. 2, the cavernous base, 12, comprises at least one base locking element, 22, which functions in concert with a back plate locking element to secure the back plate to the base. Particularly preferred as a base locking element and a back plate locking element are mating magnets. Mating magnets are known to form a strong bond with regards to pulling two items away perpendicular to the faces of the mating magnets. Mating magnets do not form a strong bond against rotational separation. By way of example, and with reference to FIG. 2, if the back plate is drawn away from the base perpendicular to the plane of the back plate mating magnets form a strong bond. If the back plate is withdrawn at an angle, with the upper portion, UP, drawn away more rapidly than the bottom portion, BP, the back plate can be more easily removed. A primary locking mechanism is provided opposite the mating magnets of the back plate locking element and base locking element wherein the primary locking mechanism comprises a tab, 26, on the back plate with a tab void, 28, in the tab. The tab is received in a recess, 30, of the base. A recess void, 32, in the recess, 30, aligns with the tab void, 28, thereby allowing a locking element, 20, to be received through the aligned recess void and tab void. The locking element inhibits rotation of the back plate, relative to the base, thereby maximizing the bond strength provided by the mating magnets of the back plate locking element and base locking element. It is preferable that the back plate locking element and base locking element be disposed away from the recess void to increase the resistance required to remove the back plate from the base. At least one secondary back plate locking element, 22 and at least one secondary base locking element, 34 and 24, can be disposed near the recess. A switch cavity, 54, allows a power switch to be accessible from the exterior as will be more fully realized after further description. Other cavities may be employed to access the interior such as for the purposes of charging the batteries or altering the light.

Figure 3:
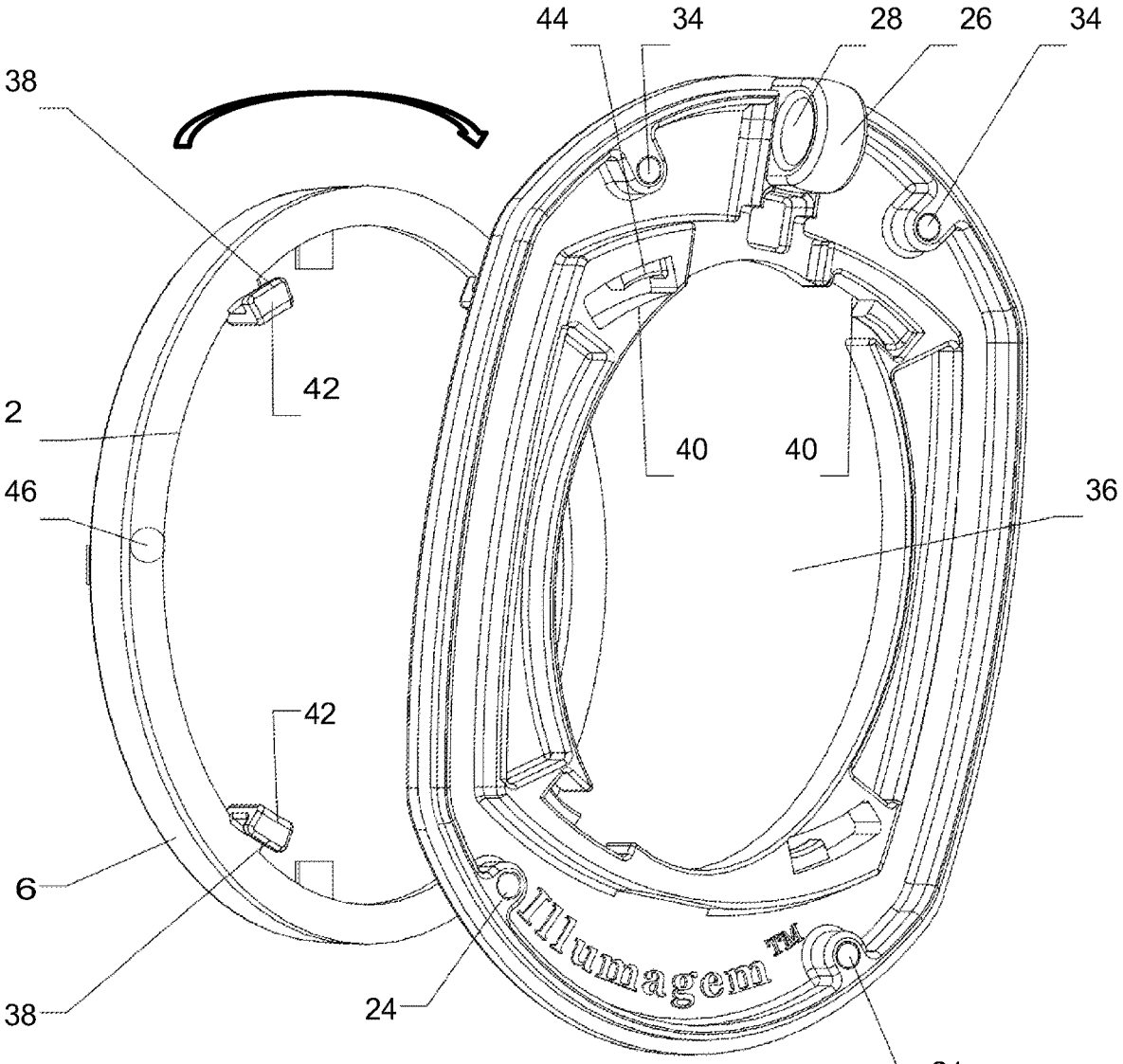
FIG. 3 is a schematic exploded perspective view of a back plate and bezel of the invention.

An embodiment of the invention will be discussed with reference to FIG. 3 wherein a back plate, 14, and bezel, 16, are illustrated schematically in exploded view. The back plate has an illumination window, 36, preferably centrally located wherein light passes to expose the illumination window and illuminates the stone. The light transmitted through the stone passes through the viewing window, 21, of the bezel. Securing tabs, 38, of the bezel, are received by securing recesses, 40, in the back plate. In a particularly preferred embodiment, each securing tab comprises at least one foot, 42, which mate with ledges, 44. In an embodiment the bezel and back plate are mated in a first rotational orientation with the securing tabs entering into the securing recesses with the feet not engaged with the ledges. After mating the bezel is rotated to a second rotational orientation wherein the feet of the securing tabs engage with the ledges of the securing recesses thereby securing the bezel and backplate in an engaged relationship. Optional, but preferred, mating locks, 46, such as mating magnets, on the bezel and back plate inhibit unintended rotation back to the first rotational orientation.

Figure 4:
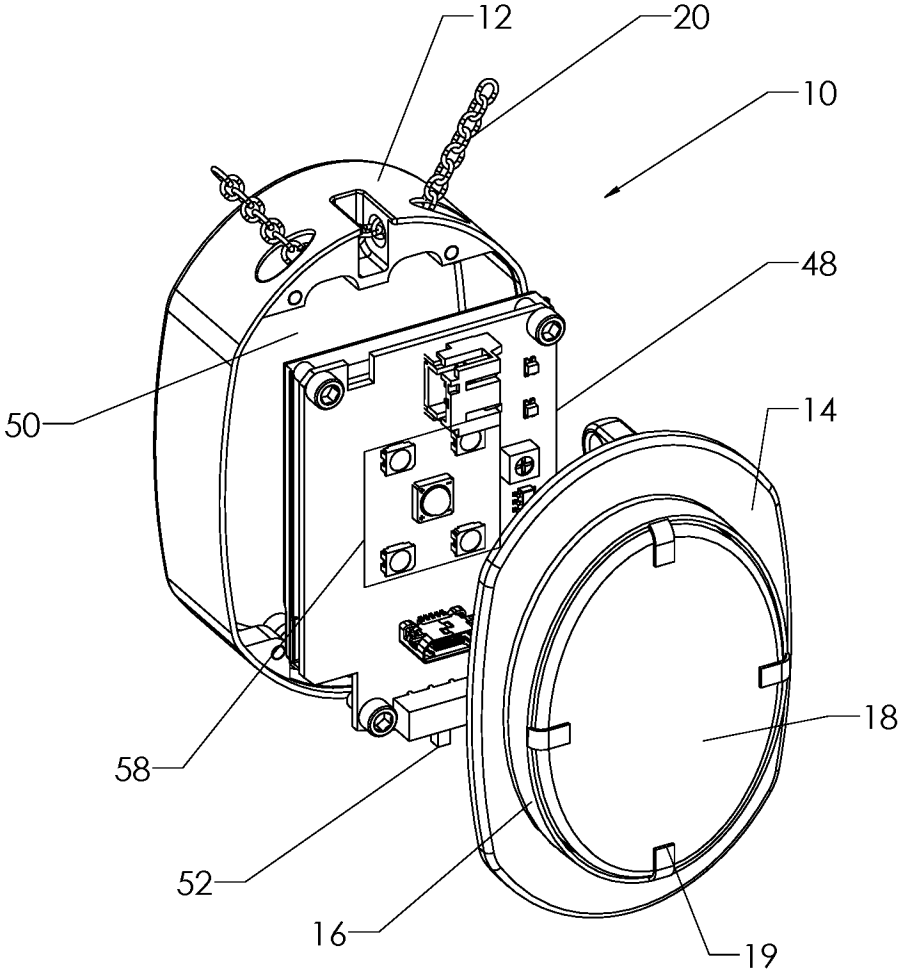
FIG. 4 is a schematic partially exploded perspective view of an embodiment of the invention.

An embodiment of the invention will be described with reference to FIG. 4 wherein a wearable device is illustrated in schematic partially exploded view. In FIG. 4 an illumination assembly, 48, is illustrated wherein the illumination assembly is received in the cavity, 50, of the base, 12. The electrical details of the illumination assembly are not particularly limited herein with suitable illumination assemblies being readily obtained commercially from a variety of sources that can be custom made to meet the limitations of size. Preferred in the illumination assembly is a power switch, 52, preferably extending through a switch cavity, 54, in the base as more easily seen in FIG. 2. The illumination assembly preferable utilizes batteries, and preferably rechargeable batteries, as a power source and it is particularly preferable that the illumination assembly comprise recharge functionality and connectivity to allow the batteries to be recharged without removal. At least one illuminator, and preferably multiple illuminators, 56, are preferably arranged to provide equal illumination over the entirety of the stone or the entirety of the illumination window. Alternatively, a diffuser, 58, may be incorporated into the illuminators, or between the illuminators and illumination window to diffuse light thereby insuring equal illumination across the illumination window. Alternatively, the illuminators may be adjustable or programmable remotely, locally or automatically. The illuminators are not particularly limited however light emitting diodes (LED's) are preferred due to the low energy consumption, small size, low cost, high output and minimal heat generation. The LED may emit visible light, ultraviolet light or combinations thereof thereby allowing any fluorescence of phosphorescence in the stone to be displayed.

Figure 5:
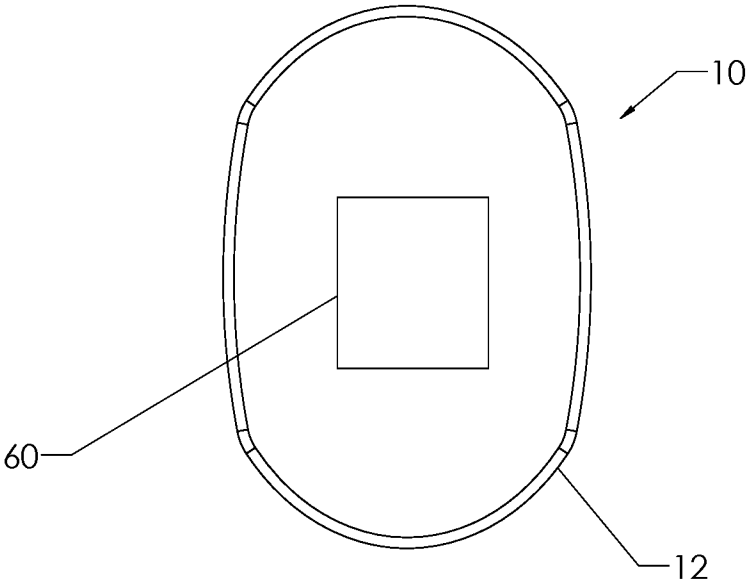
FIG. 5 is a schematic back view of an embodiment of the invention.

An embodiment of the invention will be described with reference to FIG. 5 wherein the back of a wearable device is illustrated schematically. In FIG. 5 the wearable device, 10, comprises an auxiliary mount, 60, wherein the auxiliary mount allows the wearable device to be incorporated into a mount suitable for use as an article of jewelry, incorporated into an article of clothing, or as an attire accessory. In particularly preferred embodiments the auxiliary mount represents a finger ring, an ear ring, a button, a hair accessory, a hat accessory, a clasp, a pin and pin retainer such as for a broach, a pendant, a portion of a hook and latch attachment such as VELCRO®, or combinations thereof.

The locking element is a, preferably elongated and preferably flexible, element that is capable of being inserted through the aligned recess void and tab void to inhibit the back plate from withdrawing away from the base. The locking element may have aesthetic utility. In a preferred embodiment the locking element has alternate functionality such as functioning as a lanyard or necklace such that the wearable device can be worn around the neck as a pendant. Particularly preferred locking mechanisms comprise; chains, preferably of precious metal; string; leather; cloth; wire and the like.

The stone anchor is a protrusion from the bezel which secures the stone and inhibits the stone from transiting through the viewing window of the bezel. The stone anchor is not particularly limited herein and any structure capable of securing the stone within the bezel is suitable for demonstration. Particularly preferred for demonstration of the invention are prongs. In another embodiment multiple stone anchors may be taken together to represent wire wrap wherein the wire wrap can traverse across a major portion of the stone or across a small portion of the stone. It is preferable that the stone anchor does not significantly impair visibility of the stone.

The material of construction is not particularly limited herein with the understanding that it is preferred that the wearable device, and stone, be low weight and aesthetically pleasing. Particularly preferred materials include precious metals and alloys of precious metals with silver and silver alloys being particularly preferred due to their aesthetic appeal, structural characteristics, ease of formation and cost.

The invention has been described with reference to preferred embodiments without limit thereto. One of skill in the art would realize additional embodiments which are described and set forth in the claims appended hereto.

The invention claimed is:

1. A wearable device comprising:

a base comprising:

a cavity;

at least one base locking element;

a recess comprising a recess void; and an illumination assembly in said cavity wherein said illumination assembly comprises an illuminator capable of emitting light;

a back plate mountable on said base wherein said base plate comprises:

at least one back plate locking element wherein said back plate locking element is engageable with said base plate locking element;

a tab receivable by said recess wherein said tab comprises a tab void alignable with said recess void;

an illumination window wherein said light transmits through said illumination window; and at least one securing recess;

a bezel mountable on said back plate wherein said bezel comprises:

a viewing window; and a securing tab wherein said securing tab is received by said securing recess; and a locking element extending through aligned said tab void and said recess void; and wherein said securing tab comprises at least one foot and said securing recess comprise a ledge wherein in a first rotational orientation of said bezel relative to said back plate said foot and said ledge does not engage and in a second rotational orientation of said bezel relative to said back plate said foot and said ledge do engage.

2. The wearable device of claim 1 further comprising a stone secured to said bezel wherein said stone is capable of transmitting said light.

3. The wearable device of claim 2 wherein said stone is selected from the group consisting of diamond, ruby, sapphire, emerald, amazonite, amber, amethyst, ametrine, apatite, fluorite, pyrite, fuchsite, pyrope, almandine, garnet, rhodochriste, rubellite, azurite, hawks eye, serpentine, agate, chalcedonie, iolite, jade, citrine, kunzite, tourmaline, coral, kyanite, verdite, larimar, diaspore, modavite, quartz, zirconium, and combinations thereof.

4. The wearable device of claim 1 wherein said bezel further comprises at least one stone anchor.

5. The wearable device of claim 4, wherein the stone anchor is a prong.

6. The wearable device of claim 1 wherein said base locking element and a back plate locking element are mating magnets.

7. The wearable device of claim 1 further comprising a diffuser.

8. The wearable device of claim 1 wherein said illuminator is a light emitting diode.

9. The wearable device of claim 1 wherein said locking element is selected from the group consisting of a chain, a string, leather, cloth and wire.

10. The wearable device of claim 1 further comprising an auxiliary mount.

11. The wearable device of claim 10 wherein said auxiliary mount is selected from the group consisting of a finger ring, an ear ring, a button, a clasp, a pin and pin retainer, a portion of a hook and latch attachment or combinations thereof.

* * * * *